US005842890A

United States Patent [19]

Gimenez

[11] Patent Number: 5,842,890

[45] Date of Patent: Dec. 1, 1998

[54] TERMINAL CONNECTING DEVICE

[75] Inventor: Miguel Ortiz Gimenez, Barcelona, Spain

[73] Assignee: General Electric Company, New York, N.Y.

[21] Appl. No.: 868,172

[22] Filed: Jun. 3, 1997

[30] Foreign Application Priority Data

Jun. 3, 1996 [ES] Spain ..... 9601221

[51] Int. Cl.[6] ..... H01R 9/22

[52] U.S. Cl. ..... 439/718; 439/813

[58] Field of Search ..... 439/813, 801, 439/718, 709

[56] References Cited

U.S. PATENT DOCUMENTS 5,249,989 10/1993 Alsch ..... 439/813
5,266,058 11/1993 Sako et al. ..... 439/813
5,376,024 12/1994 Sako et al. ..... 439/813
5,704,815 1/1998 Shibata et al. ..... 439/709

*Primary Examiner*—Gary F. Paumen
*Attorney, Agent, or Firm*—Carl B. Horton

[57] ABSTRACT

A terminal connecting device which is mounted between the head of a screw and a washer and acting as a gasket for such screw. The screw is to be threaded onto a stationary terminal to hold a connecting terminal for an electrical accessory (contactor, switch, thermal relay, etc.). When the terminal connecting device is lifted up, the screw is raised to a position above the stationary terminal, allowing a ring terminal to be placed between the end of the screw and the stationary terminal to make the connection of the ring terminal. The terminal connection can be made without the need to extract the screw from or to disassemble the subject accessory. The terminal connecting device has sliding means, which in combination with other means of the cover of the electrical apparatus, to guide and align the screw in the raising or lifting/ insertion movements thereof.

4 Claims, 6 Drawing Sheets

TERMINAL CONNECTING DEVICE

OBJECT OF THE INVENTION

The present invention relates to a terminal connecting device which allows for the axial movement of terminal connection screws for switches and similar apparatus, designed for being mounted or fastened to those types of terminal connection screws which may be hidden in a slot or cavity in the housing or casing of the switch or electrical accessory involved. The field of application of the present invention extends to all electrical accessories that have connections secured with screws such as contactors, pulsators, thermal relays, switches, terminal strips, etc.

BACKGROUND OF THE INVENTION

Presently, connections of certain residential electrical accessories are achieved for the most part by screws inserted into a screw hole in a support of the subject electrical accessories' housing or casing, with the screw being supplemented by a washer acting as a gasket to ensure optimum securing to the end of the cable to be connected. Because of the relative small sizes of the screws and the confined area where they are placed, they often fall out of place or get dropped when inserted or removed from the screw hole.

In commercial electrical accessories such as switches, thermal relays, etc., to facilitate the installation of the screws, slots are provided in the casings of the accessories. Said slots hold the terminals within the openings of the slots for the threading of the screws, constituting a means of placement for the screws, keeping them from being dropped, facilitating the attachment and removal of the screws from the stationary terminal to make corresponding connections and disconnections. The slots may help with the housing of the screws to prevent them from falling or being dropped, but they also impede contacts with the screws. Since the screws are inserted from the upper or external plane of the slot or cavity of the electrical accessories, they are accessible only by a narrow tool such as the tip of a screwdriver guided into the slot for the threading/unthreading of the screw.

In order to connect a termination type of cable with an end secured to a small flat plate with an aperture through which the screw passes, i.e., an eyelet or ring terminal, in either commercial or residential accessories, it is often necessary to disassemble the electrical accessory to properly position the ring terminal to allow the end of the screw to pass through the aperture of the ring terminal. If the accessory is not disassembled, then the alternative is to remove the screw by lifting it so that the end of the screw is separated from the bottom of the slot, thereby allowing the ring terminal to be placed under the end of the screw.

Evidently, the disassembling and reassembling of the electrical accessory to connect the terminal is cumbersome and time-consuming. In the case where the connection is made by moving or lifting the screw with a magnet-tip screwdriver, this process can be as equally cumbersome and time-consuming. The only maneuverable tool that is accessible to the screw is a screwdriver, and logically raising a screw through the use of a screwdriver is difficult. When a slight friction or rubbing occurs in such raising motion, the screw separates from the screwdriver and falls, impeding the positioning of the ring terminal. Additionally, even when the screw can be raised successfully, when its returns to its former position, it is often off-center with respect to the opening of the ring terminal, thereby impeding its threading or securing.

U.S. Pat. No. 5,266,058 also entitled "Terminal Connecting Device" resolves the above cumbersome and time-consuming terminal connection problem with a device which provides for the alignment between the screw and the opening of the terminal as well as the screw hole of the stationary terminal. The device comprises an elastic spring-like member and a terminal screw guiding member, with one end of the spring being held by the cover of the stationary terminal, while the other end is fixedly secured by the guiding member. The guiding member can be set into two positions, engaged and disengaged, by an engaging projection which is disposed in the cover of the terminal. In the engaged position, the terminal screw is held against the resilient force of the elastic member, abutting to or in close proximity to the screw hole in the stationary terminal. In the disengaged position, the terminal screw is supported with the aid of the resilient spring force derived from the elastic member to form a gap between the screw and the screw hole, allowing the screw to be in alignment with the top of the screw hole.

U.S. Pat. No. 5,376,024 (a division of U.S. Pat. No. 5,266,058), also entitled "Terminal Connecting Device" describes another type of terminal connection device to facilitate the connection of a terminal connector. A terminal screw may be retained by the device via a cable presser to be either of two positions, including a first position where there is a gap between the screw and the threaded hole, and a second position where the threaded screw abuts or is adjacent to the threaded hole. A fitting portion is provided in the stationary terminal to support the terminal connecting device. As with the terminal connecting device in U.S. Pat. No. 5,266,058, this device is also elastic in nature and provided with grooves, grippers or similar types of engagement pieces to be engaged with a fitting portion of the stationary terminal. The elastic nature of the device and its grippers allow the device to be engaged to retain the screw hole in either a first position where the threaded portion of the screw abuts on or adjacent to the threaded hole, or a second position where there is a gap between the threaded end of the screw and the threaded hole.

There are a few shortcomings to the aforementioned devices including a complex design and limited applications. Accordingly, it is an object of this invention to provide a terminal connection device to facilitate the fastening of a screw having a male-threaded portion into a female-threaded portion of a stationary hole with total simplicity and efficiency, allowing the positioning of a ring terminal under the lower end of the screw without need of dismounting the subject electrical accessory or without the need of having to engage in an uncontrolled and unsafe displacement or lifting of the screw.

SUMMARY OF THE INVENTION

A terminal connecting device comprises a part with a passage for the screw, as well as some mounting or fastening means below the head of the screw and with other means for making possible the axial movement or lifting of the device, carrying with it the corresponding screw and allowing a ring terminal secured to conductor cable to be inserted between the lower end of the screw and the corresponding terminal.

In the first preferred embodiment, the terminal connecting device has a circular passage for the screw head, which passage is equipped with radial grooves that allow for the passage of the screw head. The lower edge of the passage is provided with an internal lip or rib for retaining the screw head. Collaterally with the passage, there exists a rectangular and pass-through slide window in the device, allowing the device to slide axially along a guide which is an extension of the cover of the electrical accessory. The axial movement of the terminal connecting device along the guide results in the corresponding guided movement of the screw retained within said device. The base of the device is equipped with a heel to allow it to be properly positioned or retained in its axial movement. The terminal connecting device is also provided with an inclined or sloping section for the placement of a finger or tool to lift or lower the device.

In another preferred embodiment, the terminal connection device comprises a base with bottom pins equipped with internal ribs or projections for the mounting under the screw head. The base is guided in its axial movement by a casing of within the electrical accessory. The base is provided with at least a window for passage of the tip of a tool such as a screwdriver, or with a pin or lug to facilitate the upward lifting of the base.

DESCRIPTION OF THE PREFERRED FORM OF EMBODIMENT

Figure 1:
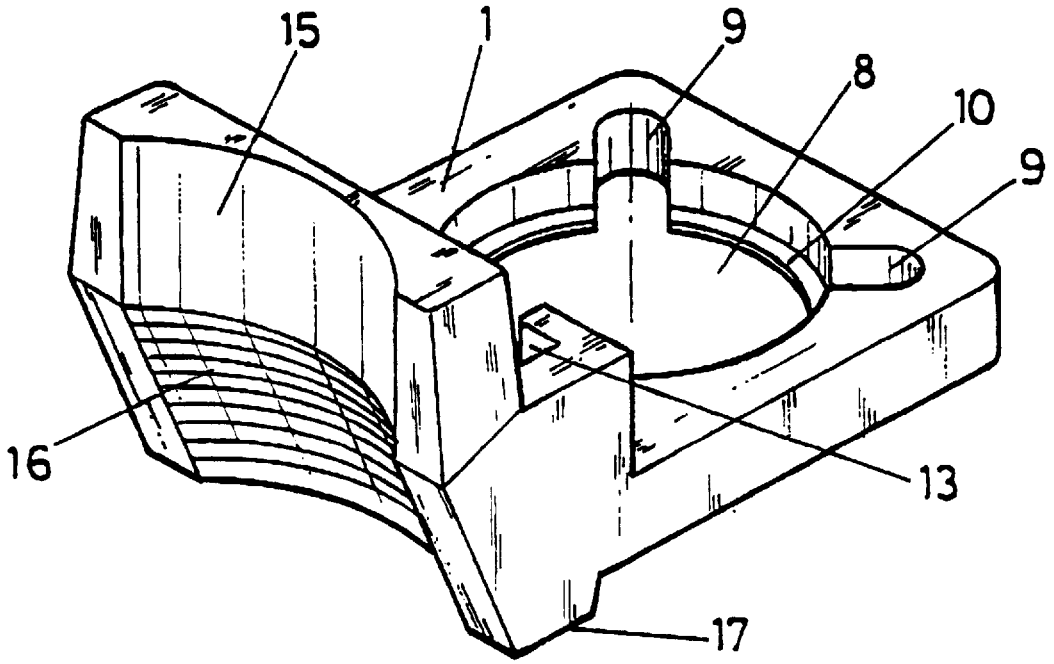
FIG. 1 is a perspective view of the part constituting the device according to one preferred embodiment of the invention.
Figure 2:
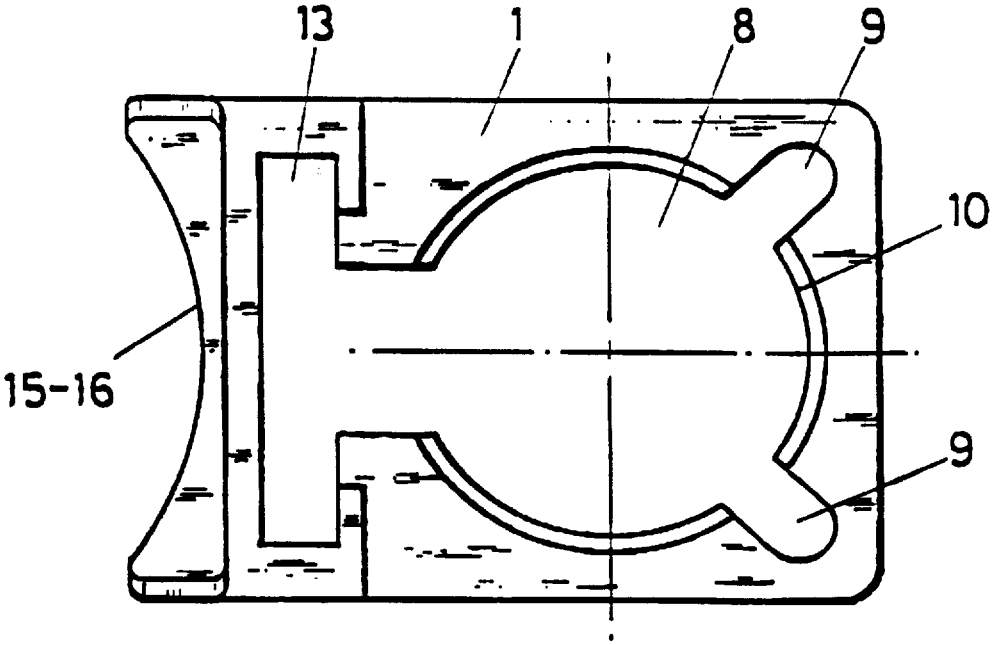
FIG. 2 is a bottom view of the same part as shown in the preceding figure.
Figure 3:
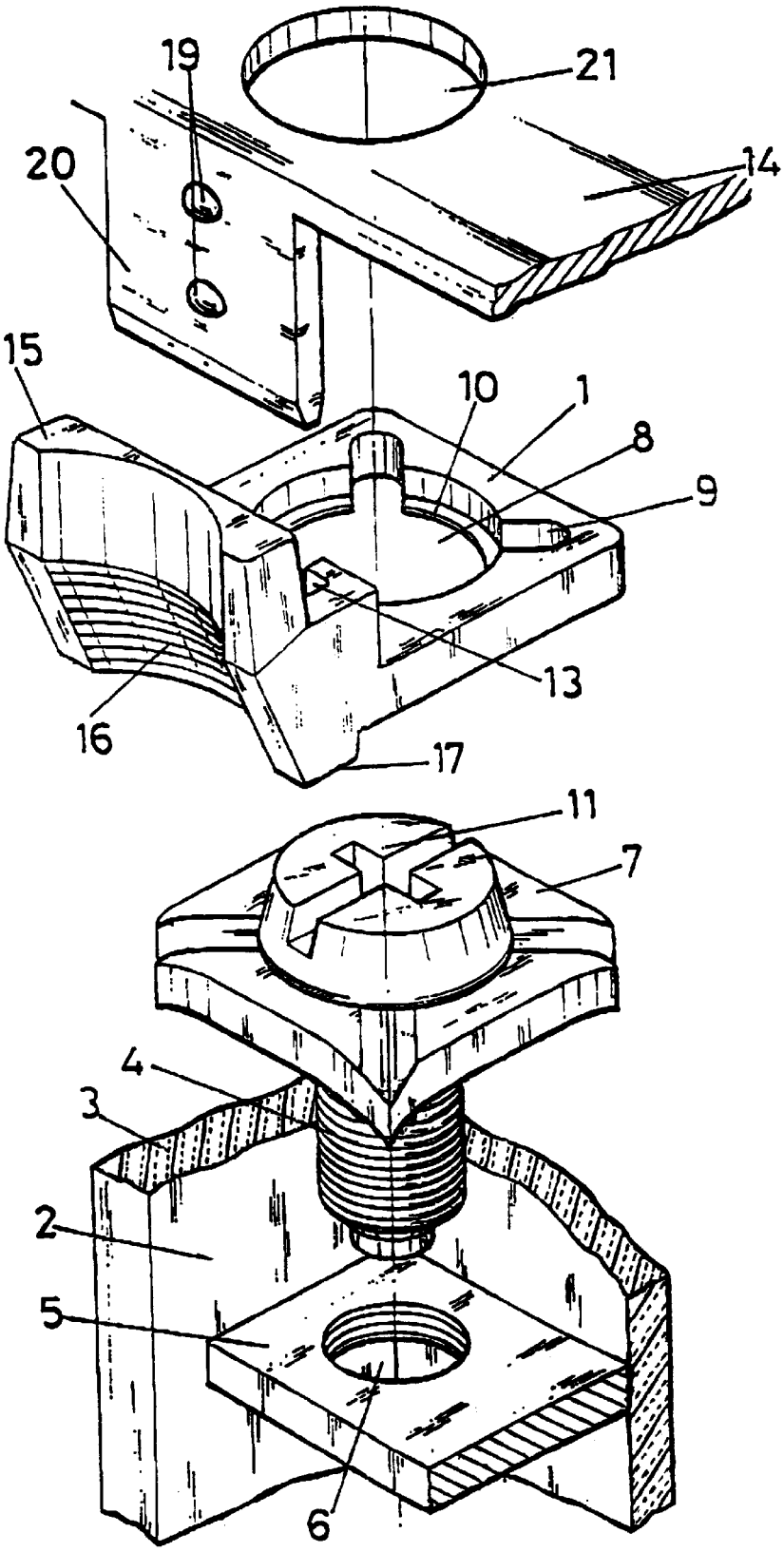
FIG. 3 is an exploded view of the terminal connection assembly, showing the part constituting the device in FIG. 1.

The terminal connecting device according to the first embodiment of the present invention is as shown in FIGS. 1 to 6. FIG. 1 is a perspective view and FIG. 2 is a bottom view of the terminal connecting device. FIG. 3 is an exploded view showing the device 1 in a terminal connection assembly.

The terminal connecting device comprises part 1, which is preferably made of plastic, formed into a rectangular or quadrangular configuration with a circular aperture or passage 8 with radial slits or cuts 9 spaced around the aperture 8. The lower edge of said passage 8 is equipped with a rib or projection 10, which functions as a lip for the retention of screw 4 (see FIG. 3). The device 1 is further equipped with a slide guide or window 13, allowing the part 1 to slide axially along a guide 20 (FIG. 3). The part 1 may also have a raised section 15 which functions as a lift handle to raise or lower the part in its vertical movement, as well as a sloped section 16 with a heel 17 for the proper positioning and retention of the part in the electrical accessory.

FIG. 3 shows that guide 20 is an vertical extension of cover 14 covering the terminal connection assembly. The guide 20 also has means such as apertures or projections 19 to set end limits to the vertical movement of the part 1. Cover 14 also has an aperture 21 to allow for the passage of a tool or screwdriver to thread/unthread screw 4. Screw 4 is for securing to and establishing the terminal connection of a conductor cable with slot 2 of the stationary connection terminal 3 of the electrical accessory. The connection plate 5 of slot 2 has a screw hole 6 into which screw 4 is threaded. Screw 4 is supplemented by a washer 7, which acts as a gasket placing pressure onto the corresponding cable or cables when screw 4 is inserted and threaded into screw hole 6 of connection plate 5. Washer 7 is secured around the smooth section 12 under and between screw head 11 and the threaded portion of screw 4 (see FIGS. 4, 5, and 6).

Figure 4:
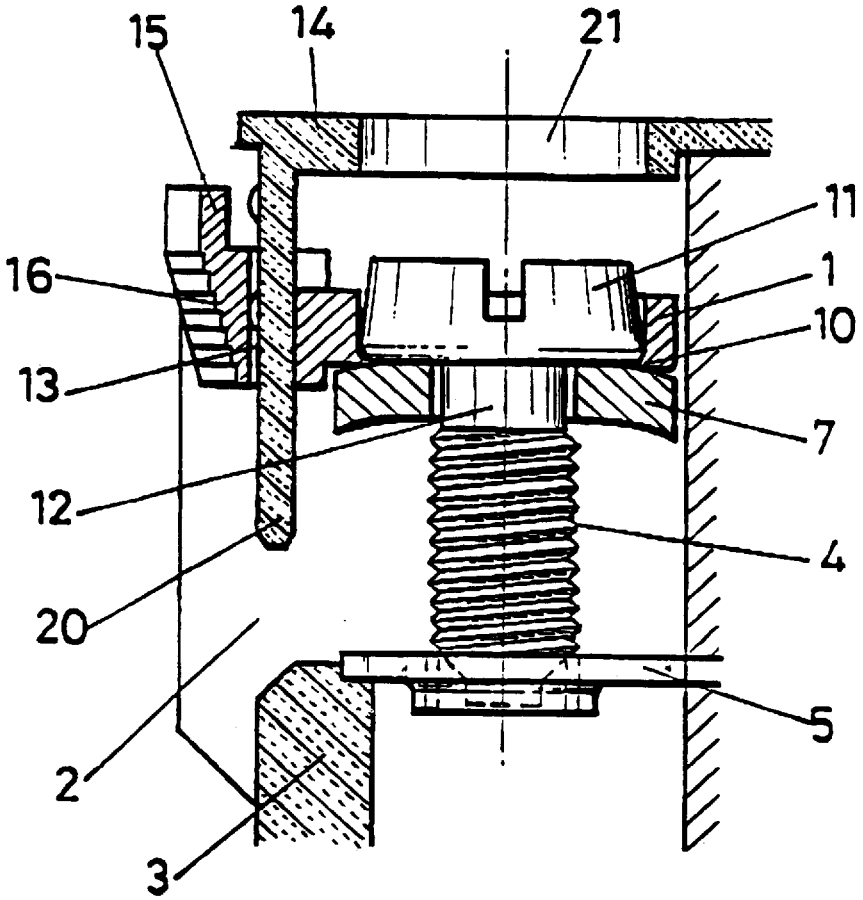
FIG. 4 is a fragmentary, sectional view of the terminal connecting device in FIG. 1 as seen from one side.
Figure 5:
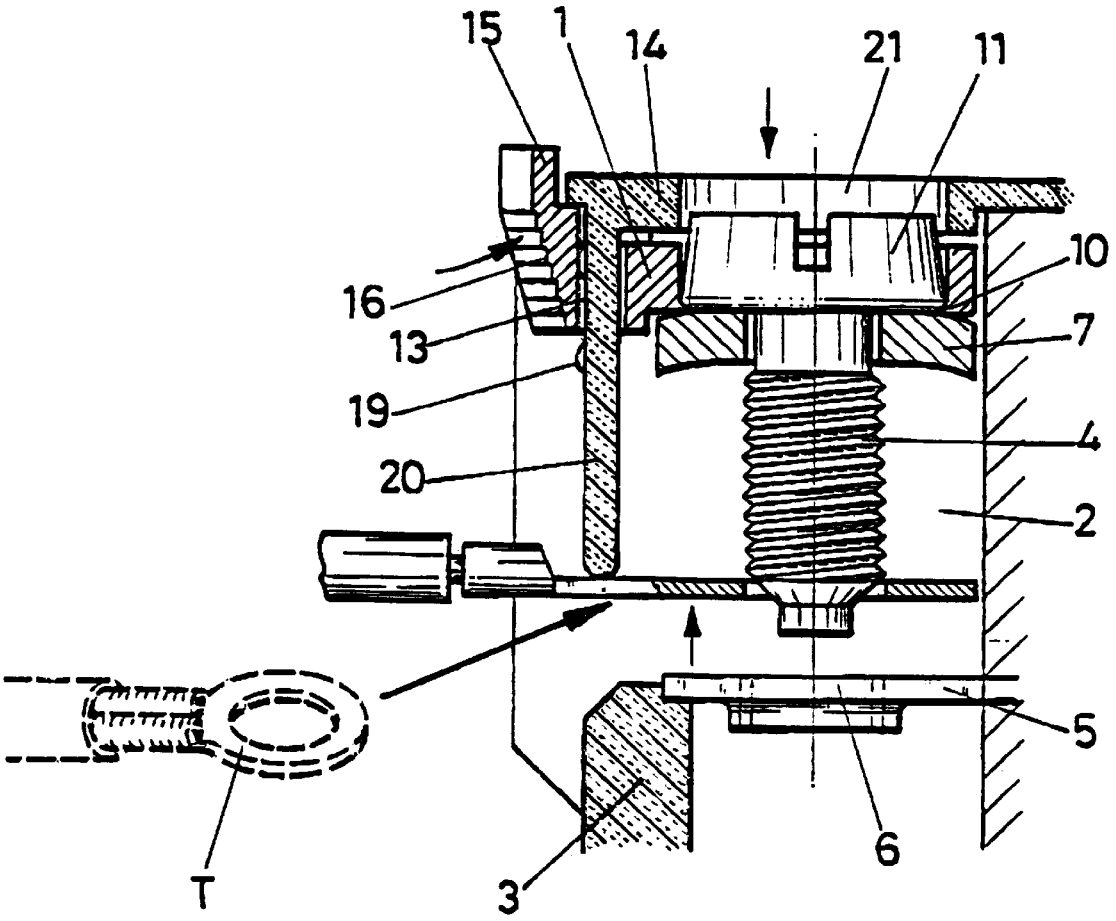
FIG. 5 is a fragmentary, sectional view of the terminal connection device in the preceding figure, showing the upward movement of the device raising the screw and allowing for the lateral introduction and positioning of a ring terminal for connection.
Figure 6:
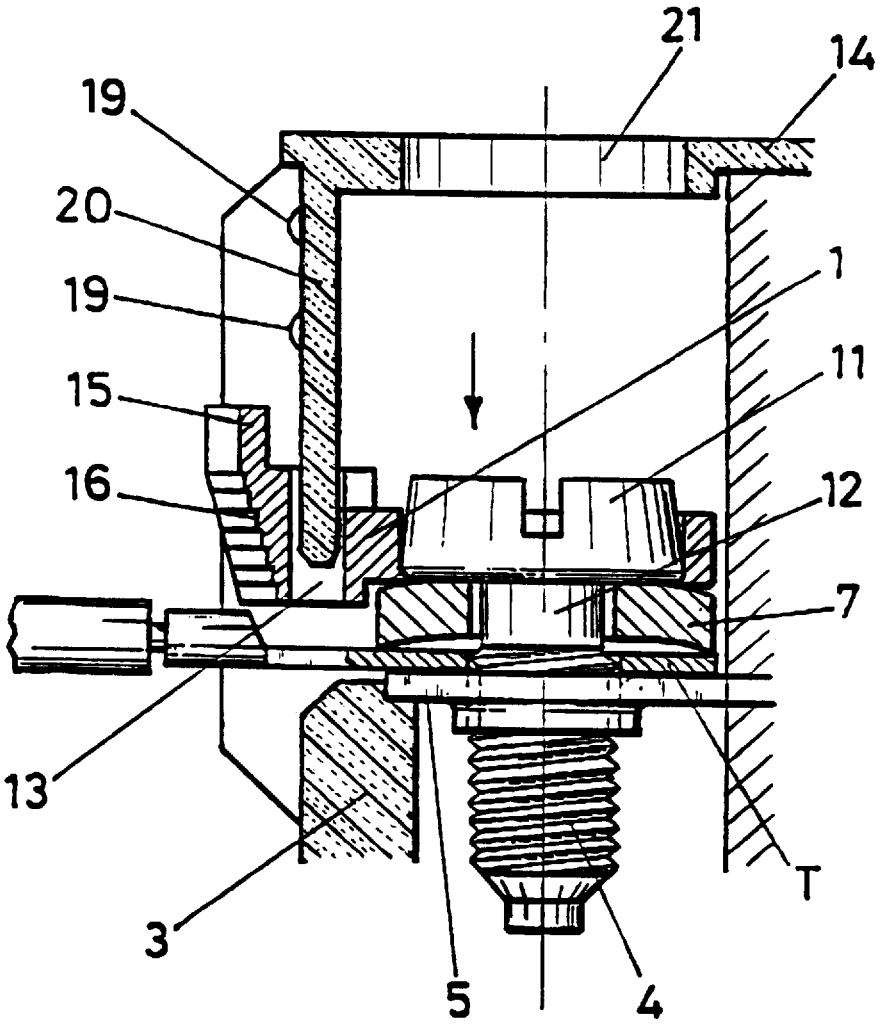
FIG. 6 is a fragmentary, sectional view of the terminal connection device in the preceding figure, showing the connection of a ring terminal.

FIGS. 4, 5, and 6 are fragmentary, sectional views of the terminal connecting device, showing the vertical movement of the device raising the screw and allowing for the lateral introduction and positioning of a ring terminal for connection. In one form of embodiment, the mounting and operation of the part I is done by first mounting screw 4 in slot 2 of the stationary connection terminal 3. The device is next mounted through the head 11 of screw 4 by passing the screw head 11 through the aperture 8 of the device 1. By elasticity, or through the bending/tilting of the device 1, the head 11 passes through the aperture 8. The radial slits or cuts in the aperture 8 help facilitate the tilting, so that the lip or rib 10 in the lower edge of the aperture 8 goes beyond the lower edge of the screw head 11, allowing the device to be mounted below head 11 of screw 4 and between the head 11 and the joined washer or gasket 7 as shown in FIGS. 4, 5 and 6. The vertical guide 20 of the cover 14 of the electrical accessory is aligned through window 13 of the device part 1 allowing for the guided axial movement of the device 1.

When screw 4 is mounted into the threaded aperture 6 of the connection plate 5 of the stationary terminal, the terminal connecting device part 1 is logically moved axially with the screw 4, since the latter is secured thereto. If the screw 4 is to be loosened and removed from the connection plate 5, the device part 1 facilitates the lifting of said screw 4 from slot 2. In order to dismount the screw 4 from slot 2, the user simply places a finger or else a suitable tool in the sloping section 16 to push the terminal connection device 1 upward, bringing with it the vertical movement of the screw 4 thereof. The screw is guided upward without shaking or shimmying of any kind along the guide 20 of the cover 14.

In other words, one begins from the position shown in FIG. 4 in which the screw 4 is in the unthreaded position, since that is the position in which the accessory is sold with the device included. Starting from what is shown in FIG. 4, proceeding to FIG. 5, showing the upward movement of the device part 1, bringing with it the lifting of screw 4 since both elements are joined. As the device is lifted, the male threaded portion of the screw 4 is separated from the connection place 5 and the screw hole 6, allowing for the insertion of a cable having a ring terminal with the aperture of the terminal directly underneath the screw 4. When screw 4 is lowered to be inserted into screw hole 6, it passes through the aperture of the ring terminal.

In summary, by means of the terminal connecting device according to the first preferred embodiment of the invention, one is able to secure the movement or lifting of a screw in a totally guided manner without any shimmying or play in an electrical apparatus, allowing for the placement or positioning of a ring terminal for making the corresponding connection, without any need for disassembling the accessory in which the screw assembly is going to be placed or any need for engaging in extraneous maneuvering to raise or lower the screw. The axial movement of the terminal connecting device is perfectly guided, and with it the screw to be connected, by a vertical guide aligned in a guiding window of the device.

Figure 7:
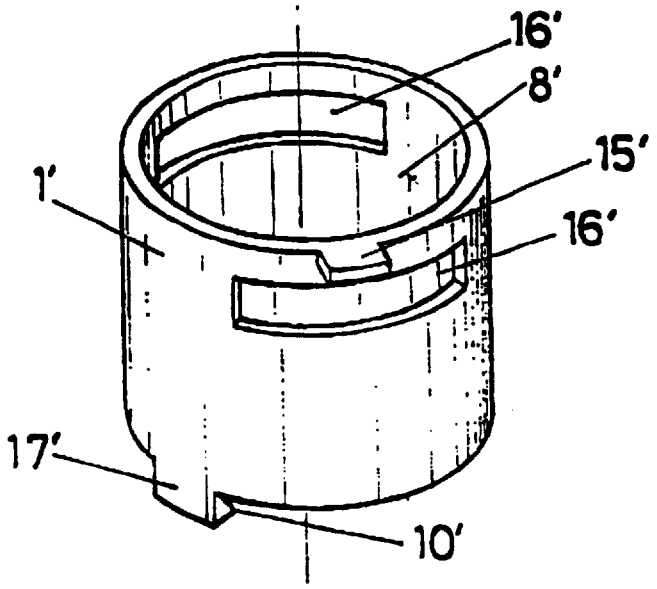
FIG. 7 is a perspective view of the part constituting the device according to a second preferred embodiment of the invention.
Figure 8:
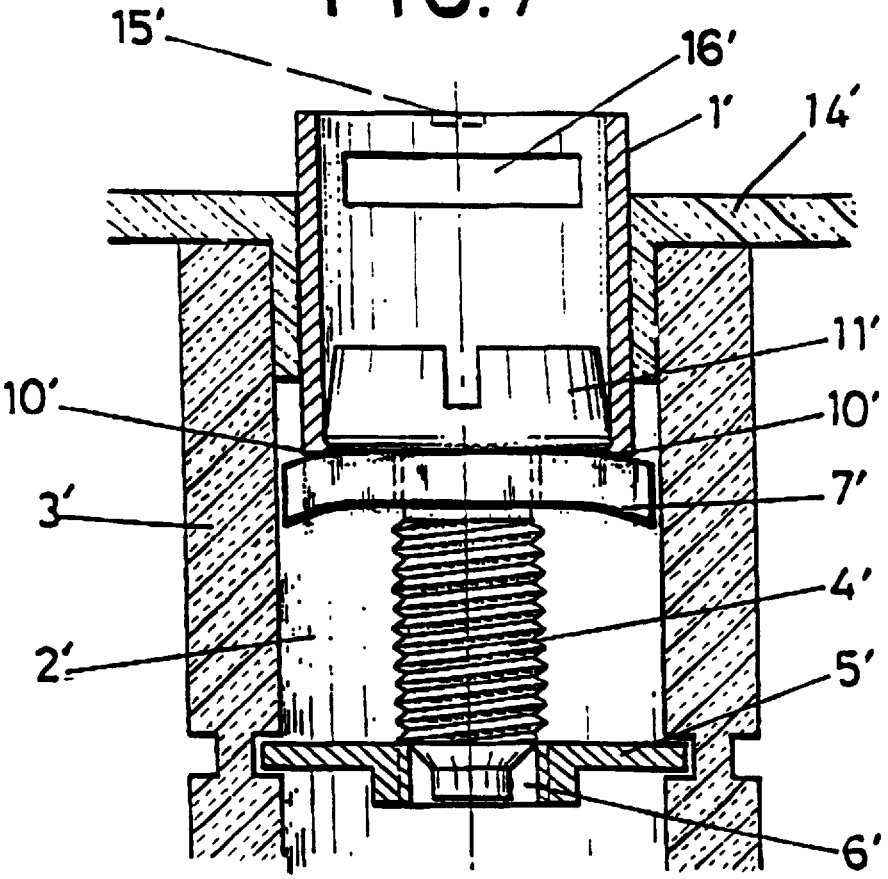
FIG. 8 is a fragmentary, sectional view of the terminal connection device in FIG. 7, showing the axial movement of the device to guide a terminal screw.

FIG. 7 is a perspective view showing another embodiment of the invention. The terminal connecting device comprises part 1' with a base having a corresponding passage 8', which is provided with pins or extensions 17'. The lower edge of each extensions 17' is equipped with an internal rib or lip 10' for the retention of or securing the head 11 ' of the screw 4'. Windows 16' are provided on the device 1' to allow the upward lifting of the device 1', consequently, screw 4' as it is seated in the device 1'. Lugs or projections 15' are provided laterally on the upper edge of the device 1', also to allow the upward lifting of the device. Screw 4' is provided with a corresponding washer 7' acting as a gasket.

The mounting and operation of the device 1' as described above can be done by the lifting of windows 16' or the manual movement of lugs or projections 15', allowing the device 1' to be axially guided or lifted within the body 3' which is an extension of the cover 14' of the electrical accessory. As the device is lifted, the end of screw 4' is raised and separated from aperture 6' of the connecting plate 5' of the stationary terminal, allowing the placement of a ring terminal in between the screw 4' and the connecting plate 5'

The forms of embodiment of the device are innumerable with the basic concept of a part with a passage for the screw as well as mounting or securing means under the screw head, guiding means for the part itself, along with means that make the corresponding movement and guiding possible in respect of both the part and the screw. The part may be any type of open ring, clamp or arched arms adaptable to the lateral surface of the screw. The guiding means can be provided on the outside or inside of the part in any suitable configuration. One skilled in the art will recognize and be able to practice many changes in the aspects of the device as described above, including variations which fall within the teachings of this invention. The spirit and scope of the invention should be limited only as set for in the claims which follow.

What is claimed is:

1. A device for the guided movement of connecting terminal screws in electrical apparatus comprising:

a. a stationary terminal having a female-threaded screw hole;

b. a terminal screw having a screw head at one end and a male-threaded portion at the other end for screwing into said female-threaded hole;

c. a cover for said stationary terminal having a vertical extension; and d. a connecting part having:

i) an aperture with internal ribs for retaining the screw head of said terminal screw;

ii) a handle for axially directing the movement of said connecting part itself and the terminal screw retained in said connecting part; and iii) a window for the insertion of said vertical extension allowing said connecting part to be slidably guided along said vertical extension.

2. A device as defined in claim 1, wherein the connecting part further comprises a projection and a flat sloping section for the placement of the finger or tool to guide the axial movement of said connecting part.

3. A device as defined in claim 1, wherein the connecting part further comprises a heel for the correct placement and retention of said connecting part in its axial movement in the electrical apparatus.

4. A device as defined in claim 1, wherein the vertical extension has at least one supplementary securing mean setting a limit for the connecting part in its axial movements.

* * * * *